United States Patent [19]

Lazarus

[11] 3,992,794

[45] Nov. 23, 1976

[54] CARPET ROLL IDENTIFICATION BRACKET AND INVENTORY CARD

[76] Inventor: Anthony C. Lazarus, 8715 First Ave., Silver Spring, Md. 20910

[22] Filed: Sept. 22, 1972

[21] Appl. No.: 291,270

Related U.S. Application Data

[63] Continuation-in-part of Ser. No. 97,104, Dec. 11, 1970, abandoned.

[52] U.S. Cl. ..... 40/309

[51] Int. Cl.[2] ..... G09F 3/08

[58] Field of Search ..... 40/309, 20 R, 124 R

[56] References Cited

UNITED STATES PATENTS

| | | | |
|---|---|---|---|
| 1,480,307 | 1/1924 | Seaton | 40/309 |
| 2,001,054 | 5/1935 | Davis | 40/309 |
| 3,327,419 | 6/1967 | Stanos | 40/20 R X |

FOREIGN PATENTS OR APPLICATIONS

| | | | |
|---|---|---|---|
| 1,000,338 | 8/1965 | United Kingdom | 40/309 |

*Primary Examiner*—Richard C. Pinkham
*Assistant Examiner*—Vance Y. Hum
*Attorney, Agent, or Firm*—W. Britton Moore

[57] ABSTRACT

An elongated flat flexible plastic plate having a bent flat portion at one end. A Velcro securing strip is mounted on the flat portion, an inventory designating card having a similar Velcro securing strip on one face thereof may be fixedly but removably arranged on the other strip. The flat plate may be inserted into a roll of carpeting and the like stored in racks so that the inventory card will be outwardly of the end of the roll and will have appropriate indicia thereon indicating style, color, size, and footage of the carpeting. The card is readily removable for revising this data when any carpeting is removed from the roll.

3 Claims, 5 Drawing Figures

CARPET ROLL IDENTIFICATION BRACKET AND INVENTORY CARD

This application is a Continuation-in-Part of my copending application Ser. No. 97,104, filed Dec. 11, 1970, now abandoned and entitled "CARPET ROLL IDENTIFICATION BRACKET AND INVENTORY CARD".

This invention relates to an elongated flat flexible plastic plate having a bent flat portion at one end for receiving an inventory card thereon, and the other end of the plate being rounded to facilitate insertion thereof between the windings of a stored roll of carpeting to indicate appropriate inventory data thereon.

It is generally old in the textile merchandizing trade to insert brackets into bolts of cloth so that inventory cards thereon will be readily visible to interested viewers. However, such bolts are light and are easily handled, and it has not been important to securely attach the cards thereto. In addition, it has long been the practice in the handling and merchandizing of heavy and bulky rolls of carpeting, particularly in warehouses, to transport the rolls by mobile fork lift equipment and store them in racks arranged along the walls. It is usually the practice to attach inventory tags or cards to the rolls of carpeting by wire, but the size, bulk and weight of the rolls and the rough handling during storage often cause the tags to be torn therefrom and lost. It is also difficult to remove the tags from the rolls when carpeting is removed therefrom to keep a current inventory of the amount remaining in the roll. Applying and removing tags is time consuming and is usually effected by one employee while the others watch, which naturally multiplies lost time and increases expense. Thus, it is generally impossible to accurately determine how much carpeting is in a particular roll.

The principal object of the present invention is to provide an elongated flat flexible plastic plate having a bent portion at one end with a Velcro mounting strip arranged on one face thereof for receiving and securely, but removably mounting thereon, an inventory card with a similar Velcro strip on a face thereof whereby upon insertion of the plate between the windings of a roll of carpeting the card will extend across an end of the roll and will make appropriate data readily visible.

A further object is the provision of an elongated flat flexible plastic plate having a portion bent at generally right angles thereto on one end thereof to receive an inventory card thereon, and with the other end being rounded to facilitate the insertion and removal of the smooth faces of the plate between the windings of a carpet roll.

Another object is the provision of a flexible bracket plate for an inventory card which has sufficient flexure to facilitate its ready assembly and disassembly from carpet rolls regardless of their stacked positions in warehouses.

A still further object is to provide an integrally formed, light weight, easily stacked, flexible, plastic inventory card carrying bracket plate which may be inexpensively produced but will securely but removably support inventory cards in positions clearly visible and available for recording appropriate inventory data thereon.

In practicing the invention, the elongated flat flexible plastic plate is produced from a suitable plastic so that one end is bent at right angles to the length and the other end is rounded to facilitate assembly between the windings of a carpet roll. A Velcro strip is attached to the outer face of the bent portion and is adapted to interengage a similar Velcro strip on the underside of an inventory card whereby the latter is arranged parallel to and is backed by the bent portion. Thus, when the plate is flexibly inserted within a roll of carpeting the bent portion may flatly engage the end of the roll and the card will extend thereacross and be clearly visible for indicating data relating thereto.

These and other objects and advantages will be apparent as the following specification is considered with the accompanying drawings, wherein.

Figure 1:
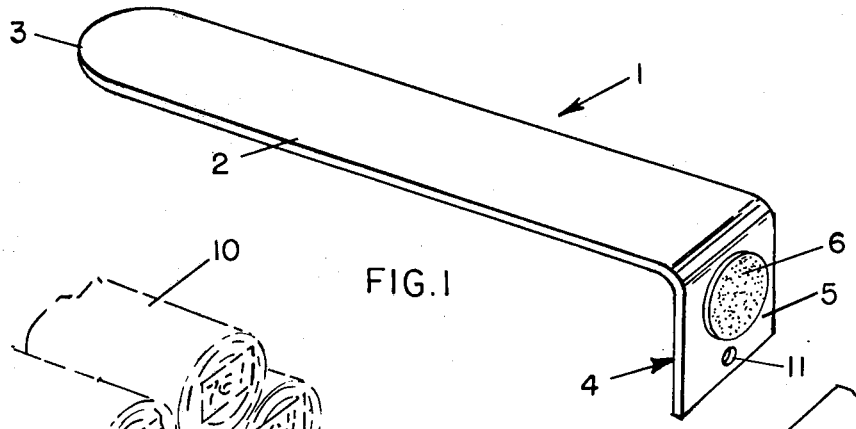
FIG. 1 is a perspective view of an elongated flat plastic bracket embodying the present invention.

Referring more particularly to the drawings, wherein similar reference characters designate like parts throughout the several views, the numeral 1 generally designates the bracket which includes an elongated flat flexible plate 2 having one end rounded, as at 3, and the other end formed with an integral, generally right-angled, bent portion 4 having a flat substantially rectangular outer face 5. The plate is formed of some suitable resilient plastic for example, polystyrene, and is of such a width, generally between 1 to 3 inches, and thickness that it is inherently flexible and the faces and edges thereof will be smooth and relatively slick to facilitate insertion and removal thereof between the windings of a roll of carpeting and the like, as will presently be described.

Figure 2:
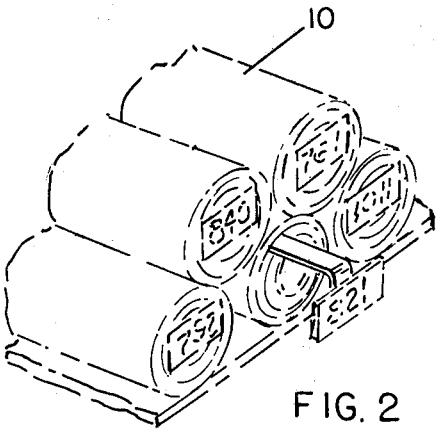
FIG. 2 is a perspective view on reduced scale showing the relative positions of the brackets and cards and carpet rolls when assembled and during asembly.
Figure 3:
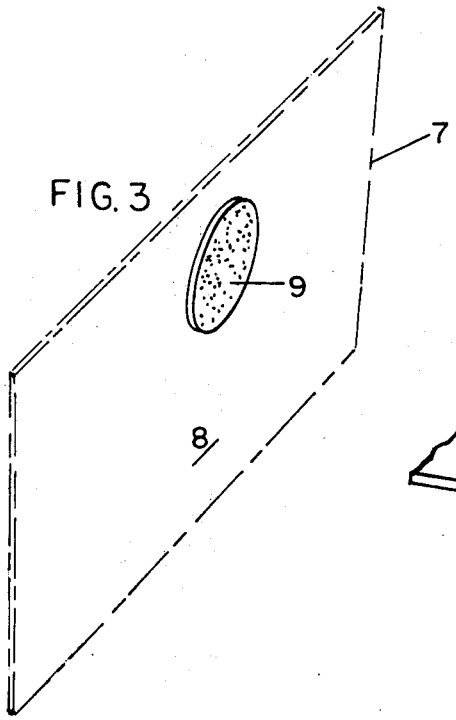
FIG. 3 is a perspective view of a card with a Velcro strip on one face thereof.
Figure 4:
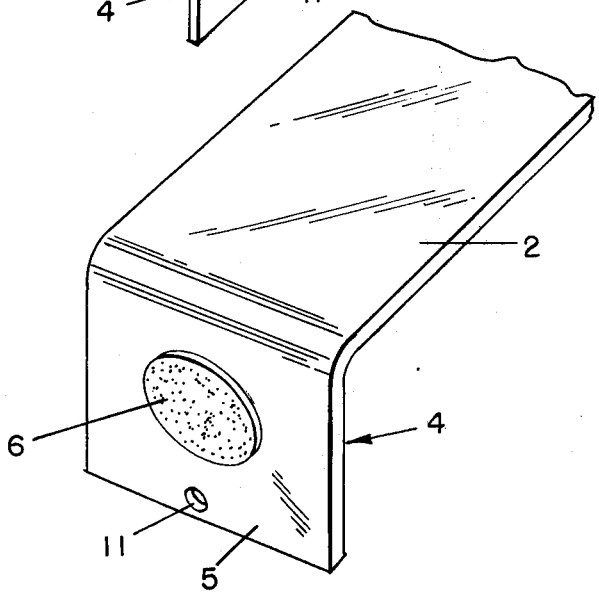
FIG. 4 is a perspective view of the bent end of a bracket showing a Velcro strip arranged thereon.

A mounting patch or tab 6 may be suitably secured on the outer face 5 of the bent end portion 4 by adhesive and the like, not shown, and a similar patch or tab 9 arranged on and attached to the rear face 8 of an inventory card 7, which may be of paper or cardboard or other suitable flexible material, is adapted to interengage and interlock with the patch 6. Thus, the patches are securely locked together so that the card 7 is fixedly and immovably supported on the outer face of bent portion 4. As can be seen in FIGS. 2 and 3, the attachment system used enables the inventory card 7 to be larger than the bent end 4 of bracket 1, with the result that the inventory tag is larger than those used in known prior art devices. Thus, the card is easier to handle, can be more readily seen, and can have more inventory data inscribed thereon. In view of the curly pile nature of the Velcro material embodying a plurality of closely associated rows of flexible resilient broken loop hook members, not shown, disengagement and separation of one patch from the other is easily effected. Such a fastening means is conventional and need not be herein further described in detail. It will be noted, however, that the patches 6 and 9 are circular in shape. Experiment has shown that a circular shape lends itself best to the longevity of the patch and its securement to both the inventory card and bracket. A square or rectangular patch tends, after repeated use, to lift at one of the corners with the securing adhesive eventually weakening and the patch of Velcro becoming dislodged. A circular patch, on the otherhand, offers no corners or weak points in its perimeter which is subject to attack upon repeated removal of the inventory card from the bracket. Instead, it distributes any lifting forces, which may tend to disturb its adhesive bond, more evenly around its circumference.

It is well known that carpeting is constructed in varying textures, widths and lengths, and is customarily wound into rolls to facilitate transportation, handling and storage. Because of the length, size and weight of such rolls, they are difficult to manage and store in warehouses on the racks so that identifying data relating thereto may be arranged thereon. Thus, it is the purpose of the present identification bracket that the rounded inner end 3 of the elongated flexible plate 2 be inserted between the windings of a roll 10 of carpet, preferably adjacent to the center winding core, not shown, upon which the carpeting is usually wound to impart some degree of rigidity thereto. Due to the inherent flexibility of the elongated plate 2, the rounded inner end will fit between and slide with ease between the windings until the rear face of the bent end portion 4 flatly engages the end of the roll. A small hole 11 may be included in bent end 4 to permit the attachment thereto of a conventional tag with string or wire. Such a situation may arise when a new carpet roll is first received at the warehouse with the manufacturer's inventory tag wired thereon. This tag can temporarily be wired to the bracket 1 prior to transferring the information contained thereon onto the card 7 of the invention.

As paper wrapped carpet rolls are received in the warehouse, prenumbered and separately colored inventory tags are assigned thereto, with this information being recorded on a receiving sheet with the original mill roll number, so that a card inventory is established with both numbers retained thereon. It is not necessary to remove the wrapping paper from the roll, but merely to slit the end thereof and insert the flexible plastic bracket thereinto and apply the tag to the bent end thereof.

It is usually easier to first insert the brackets in the rolls of carpeting and thereafter attach the inventory cards thereto, when a bracket is so arranged within a roll, the Velcro patch 9 on an inventory card with appropriate data inscribed thereon may be pressed into engagement with the patch 6 on the bracket to effect secure attachment thereof. Thereafter, should it be necessary to remove the roll from its storage rack to permit the removal of a certain length of carpeting therefrom, the card and/or the bracket may be removed from the roll and the latter unwound to permit severance of the desired length. Thereafter, the inventory data is changed on the card, the carpet rewound and returned to its rack or place of storage, the bracket reinserted and the card reattached thereto.

An important benefit derived from using the present bracket and tag is the increased ease of identification of every roll in the warehouse carpet inventory. Since each tag is clearly visible, a quick count can be made of the different types of carpets in stock, and, because the tags themselves are readily removable, they can be removed from the brackets, with their number being pencilled, or otherwise noted, on the bracket. The cards can then be sorted, either by name, color, number, or other charterizing features, and finally the information contained on the back of the cards can be compared against an office card inventory file. The tags are then replaced on their appropriate brackets. Thus, an exact inventory can be effected under office conditions without having to inspect permanently affixed tags in the warehouse itself under the most difficult of circumstances.

Figure 5:
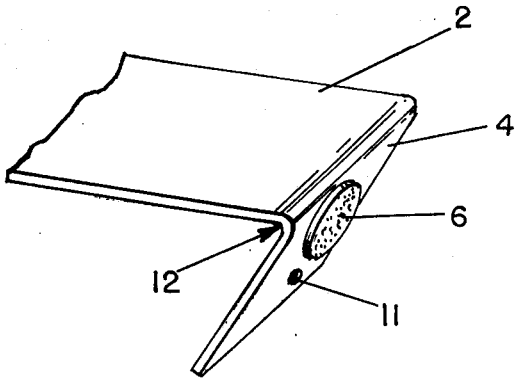
FIG. 5 is a perspective view of the bent end of a bracket showing another embodiment thereof.

In situations where the carpet rolls are stored in tiers of racks it sometimes becomes difficult to see the inventory tags on the uppermost rolls, since they are above and angled away from the plane of vision of the viewer. In this instance, it may be desirous to use a modified version of the invention, as illustrated in FIG. 5, wherein a generally acute angle is formed at 12 between bent end 4 and plate 2 of bracket 1. A convenient range of angles would lie somewhere between 60 to 70°. With such an angle, the tags on carpets stored at higher elevations will tend to be more perpendicular to the viewers plane of vision and thus easier to view.

While I have illustrated and described a preferred embodiment of my carpet roll identification bracket and inventory card, it will be apparent that various improvements may be made without departing from the scope and spirit of the appended claims.

What I claim is:

1. A carpet roll storage inventory card and support means therefor comprising an elongated flexible flat plastic plate, one end of said plate being round, and the other end thereof being generally bent at an acute angle with respect to said one round end to provide a relatively narrow substantially rigid supporting surface, said plate being adapted to be inserted between the windings of a roll of carpeting, generally circular Velcro securing patch means centrally arranged on one face of said supporting surface, and a flexible card larger in size than said supporting surface whereby a substantial area thereof projects beyond and is unsupported by said supporting surface and also having Velcro securing patch means similarly shaped and correspondingly located on one face thereof, said patch means being spaced from the edges of said rigid bent end and said flexible card, whereby said patch means are interengaged and interconnected to fixedly mount said card on said vent end to enable a projected and unsupported portion of said card to be grasped and pulled for card removal and to permit ready changes to be made in the inventory data inscribed on a face thereof and the card reattached thereto, said rigid supporting surface and said card attached thereto being disposed at an angle when arranged either above or below normal eye level to facilitate viewing thereof.

2. In a carpet roll storage inventory card and support means as claimed in claim 1, wherein said card is colored and prenumbered for identification purposes.

3. In a carpet roll storage inventory card and support means as claimed in claim 1, wherein said bent end rigid supporting surface has a hole therein for securing an identification tag thereto.

* * * * *